US008132626B2

(12) United States Patent
Pietras

(10) Patent No.: US 8,132,626 B2
(45) Date of Patent: Mar. 13, 2012

(54) METHODS AND APPARATUS FOR CONNECTING TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/615,047

(22) Filed: Nov. 9, 2009

(65) Prior Publication Data

US 2010/0051257 A1 Mar. 4, 2010

Related U.S. Application Data

(63) Continuation of application No. 11/221,432, filed on Sep. 8, 2005, now Pat. No. 7,617,866, which is a continuation of application No. 09/762,699, filed as application No. PCT/GB99/02710 on Aug. 16, 1999, now Pat. No. 6,976,298.

(30) Foreign Application Priority Data

Aug. 24, 1998 (GB) ..... 9818363.5

(51) Int. Cl.
*E21B 19/16* (2006.01)

(52) U.S. Cl. ..... 166/380; 166/77.51; 166/85.1

(58) Field of Classification Search ..... 166/77.51, 166/77.52, 78.1, 85.1, 380
See application file for complete search history.

(56) References Cited

U.S. PATENT DOCUMENTS

| | | | | |
|---|---|---|---|---|
| 2,292,268 | A | 8/1942 | Gibbons et al. | |
| 3,131,778 | A | 5/1964 | Emerson et al. | |
| 3,776,320 | A | 12/1973 | Brown | |
| 4,065,941 | A | 1/1978 | Aoki | |
| 4,204,910 | A | 5/1980 | Koshkin et al. | |
| 4,524,833 | A | 6/1985 | Hilts et al. | |
| 4,625,896 | A * | 12/1986 | Rocchelli | 222/180 |
| 4,800,968 | A | 1/1989 | Shaw et al. | |
| 4,878,546 | A | 11/1989 | Shaw et al. | |
| 4,904,228 | A | 2/1990 | Frear et al. | |
| 5,186,441 | A | 2/1993 | Berti et al. | |
| 5,255,751 | A * | 10/1993 | Stogner | 175/203 |
| 5,314,032 | A | 5/1994 | Pringle et al. | |
| 5,617,926 | A | 4/1997 | Eddison et al. | |
| 5,671,816 | A | 9/1997 | Tibbitts | |
| 6,056,060 | A | 5/2000 | Abrahamsen et al. | |
| 6,390,190 | B2 | 5/2002 | Mullins | |
| 6,976,298 | B1 * | 12/2005 | Pietras | 29/428 |
| 7,617,866 | B2 * | 11/2009 | Pietras | 166/77.51 |

* cited by examiner

*Primary Examiner* — William P Neuder
(74) *Attorney, Agent, or Firm* — Patterson & Sheridan, LLP

(57) ABSTRACT

A connection apparatus for coupling a top drive to a tubular gripping member comprises a body having a first joint coupled to the top drive and a second joint coupled to the tubular gripping member, wherein the body is adapted to allow fluid communication between the top drive and the tubular gripping member and to allow relative movement between the top drive and the tubular gripping member.

16 Claims, 7 Drawing Sheets

12
13
11
15
30
18
16
28
31
19
29
1
22
32
26
24
x
20
4
40

METHODS AND APPARATUS FOR CONNECTING TUBULARS USING A TOP DRIVE

CROSS-REFERENCE TO RELATED APPLICATIONS

This application is a continuation of U.S. patent application Ser. No. 11/221,432, filed Sep. 8, 2005, now U.S. Pat. No. 7,617,866; which is a continuation of U.S. patent application Ser. No. 09/762,699, filed May 10, 2001, now U.S. Pat. No. 6,976,298; which claims benefit of International Application No. PCT/GB99/02710, filed Aug. 16, 1999. Each of the aforementioned related patent applications is herein incorporated by reference in its entirety.

BACKGROUND OF THE INVENTION

1. Field of the Invention

This invention relates to methods and apparatus for facilitating the connection of tubulars using a top drive and is more particularly, but not exclusively for facilitating the connection of a section or stand of casing to a string of casing.

2. Description of the Related Art

In the construction of wells such as oil or gas wells, it is usually necessary to line predrilled holes with a string of tubulars known as casing. Because of the size of the casing required, sections or stands of say two sections of casing are connected to each other as they are lowered into the well from a platform. The first section or stand of casing is lowered into the well and is usually restrained from falling into the well by a spider located in the platform's floor. Subsequent sections or stands of casing are moved from a rack to the well centre above the spider. The threaded pin of the section or stand of casing to be connected is located over the threaded box of the casing in the well to form a string of casing. The connection is made-up by rotation therebetween.

It is common practice to use a power tong to torque the connection up to a predetermined torque in order to perfect the connection. The power tong is located on the platform, either on rails, or hung from a derrick on a chain. However, it has recently been proposed to use a top drive for making such connection either alone or in combination with a power tong.

It has been observed that sections or stands of tubulars are often not as uniform as desired. In particular, the sections or stands of tubulars are often not straight. The top drive is in perfect alignment with the centre of the spider in the platform of an oil or gas rig. However, a section or stand of tubulars located in the spider would not always be in alignment with the top drive.

SUMMARY OF THE INVENTION

In one embodiment, there is provided an apparatus for facilitating the connection of tubulars using a top drive, the apparatus comprising a stator attachable to said top drive, and a supporting member for supporting a tool wherein means are provided to allow substantially horizontal movement of said supporting member.

In another embodiment, there is provided a method for facilitating the connection of tubulars using a top drive, the method comprising the steps of attaching a tool to the top drive using a supporting member and adjusting the supporting member to cause the tool to be displaced horizontally relative to the top drive.

In yet another embodiment, a connection apparatus for coupling a top drive to a tubular gripping member comprises a body having a first joint coupled to the top drive and a second joint coupled to the tubular gripping member, wherein the body is adapted to allow fluid communication between the top drive and the tubular gripping member and to allow relative movement between the top drive and the tubular gripping member.

In yet another embodiment, a connection apparatus for coupling two devices for handling a wellbore tubular comprises a first connection member attached to a first device; a second connection member attached to a second device; and a connection tubular operatively coupled to the first connection member and the second connection member, wherein the connection tubular is adapted to provide fluid communication between the first device and the second device and allow relative movement between the first device and the second device.

BRIEF DESCRIPTION OF THE DRAWINGS

For a better understanding of the present invention and in order to show how the same may be carried into effect reference will now be made, by way of example, to the accompanying drawings, in which.

DETAILED DESCRIPTION

Figure 1:
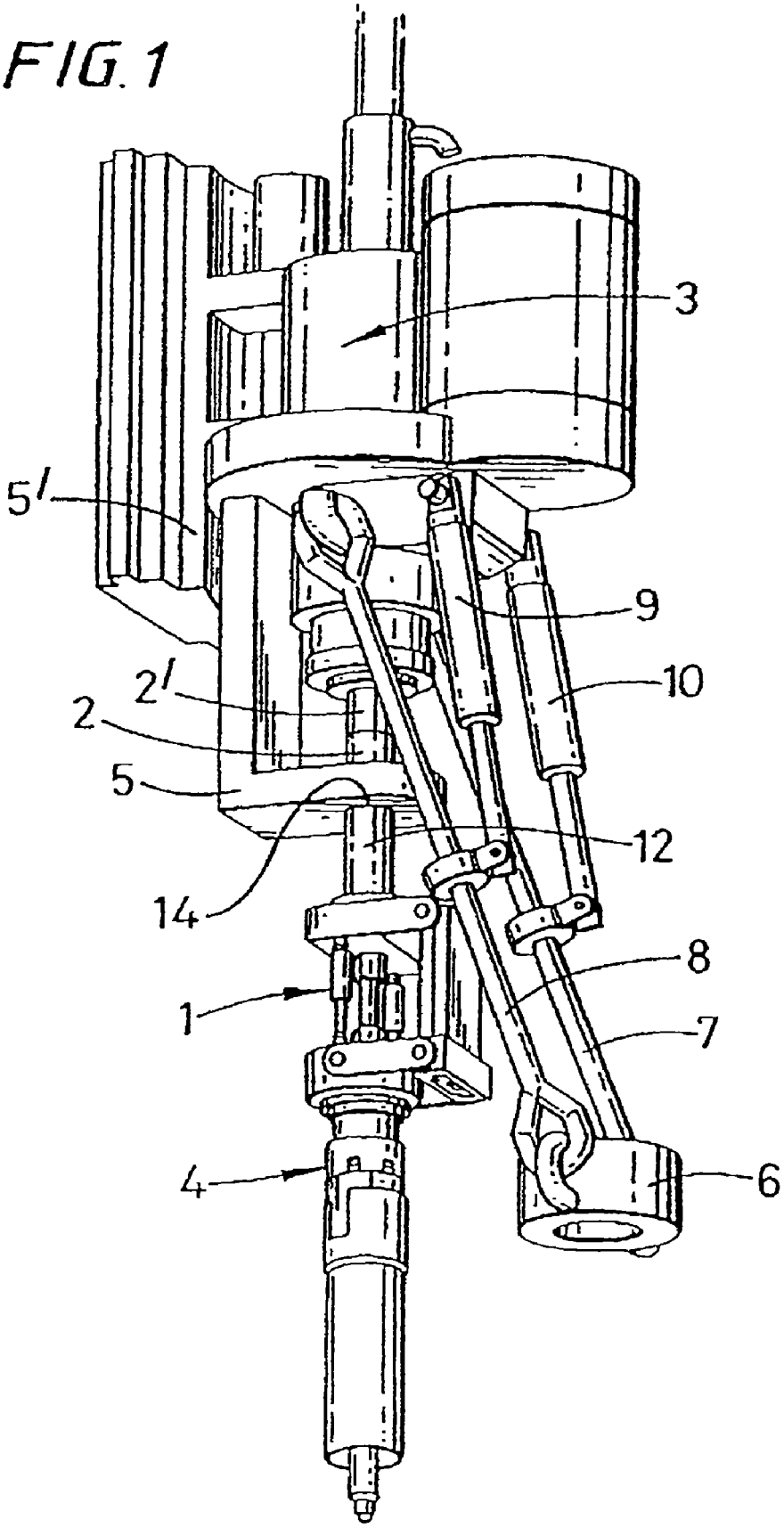
FIG. 1 is a side view in perspective of an apparatus in accordance with an embodiment of the invention in use.

Referring to FIG. 1 there is shown an apparatus which is generally identified by reference numeral 1.

The apparatus 1 depends from a rotor 2' of a top drive 3. A tool 4 for gripping a tubular depends from the lower end of the apparatus 1. A rigid guide member 5 is provided to guide the rotor 2 of the apparatus 1. The rigid guide member 5 is fast with a stator 5' of the top drive 3. The rotor 2' of the top drive 3 is coupled by a threaded connection to the rotor 2 of the apparatus 1. The rigid guide member 5 may be provided with a clamp for clamping the rotor 2 of the apparatus 1 so that the threaded connection to the rotor 2' of the top drive 3 can be made, after which the clamp would be released.

An elevator 6 is provided on the end of bails 7, 8 which are hung from the top drive 3. Piston and cylinders 9, 10 are arranged between the bails 7, 8 and the top drive 3 for moving the elevator 6 from below the top drive 3 to an out of the way position.

Figure 2:
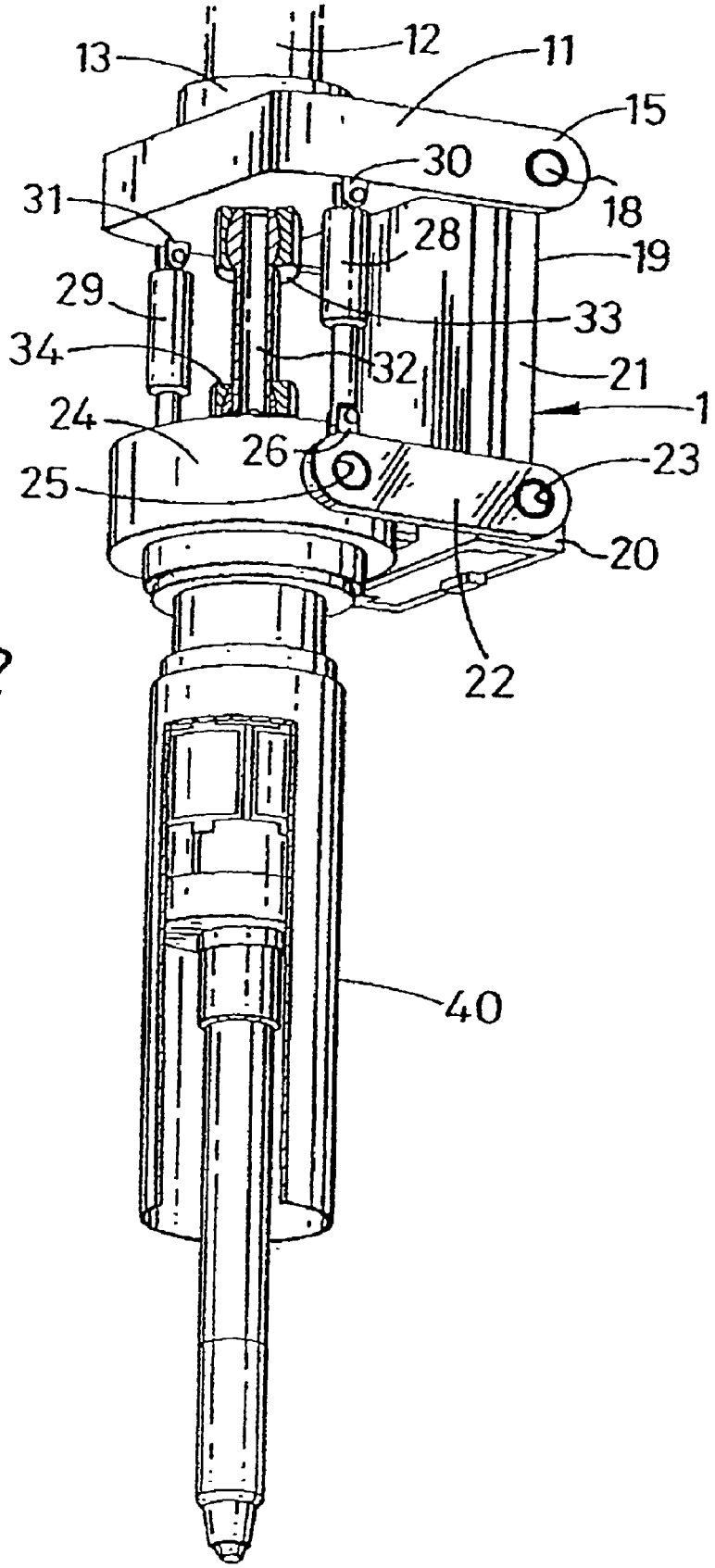
FIG. 2 is an enlarged view of parts of FIG. 1, with parts inserted in a tubular and with parts cut away.

Referring now to FIG. 2, there is shown the apparatus 1 which comprises a plate 11 which is fixed to a connecting tubular 12 by a collar 13. The connecting tubular 12 passes through a hole 14 in rigid body 5 and connects with the rotor 2 (FIG. 1). The plate 11 has two projections 15 and 16 which have holes 17 for accommodating axles 18 which are rotationally disposed therein. The axles 18 are integral with a rigid body 19. A slider 20 is arranged on runners 21 on either side of the rigid body 19. Arms 22 are connected at one end to the slider 20 via spherical bearings 23.

The other end of arms 22 are connected to a supporting member 24 via spherical bearings 25.

The arms 22 and are provided with lugs 26 to which one end of a piston and cylinder 28 and 29 is attached and are movable thereabout. The other end of each piston and cylinder 28 and 29 is attached to lugs 30 and 31 and is movable thereabout. The lugs 30 and 31 are fixed to plate 11.

Figure 3:
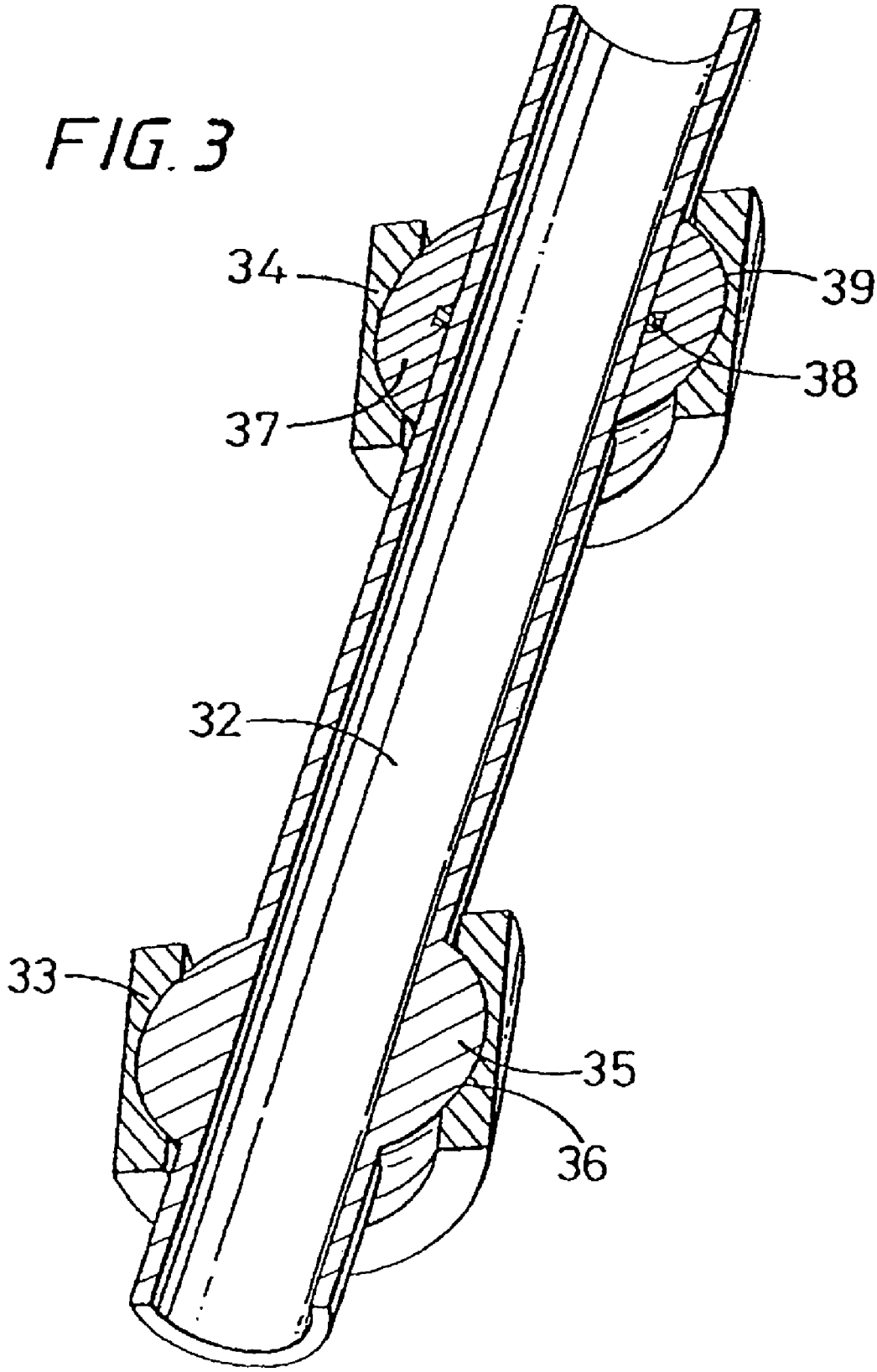
FIG. 3 is an enlarged cross-sectional view in perspective of part of the apparatus of FIG. 1.

A mud pipe 32 is provided between the plate 11 and the supporting member 24 for carrying mud to the inside of a tubular therebelow. The mud pipe 32 is located in cylindrical sections 33 and 34 which are attached to the plate 11 and the supporting member 24. The mud pipe 32 is provided with a lobe 35 formed on the outer surface thereof and is located in a corresponding recess 36 in a cylindrical section 33 (FIG. 3). A lobe 37 is slidably arranged on the lower end of the mud pipe 32 with an o-ring seal 38 arranged therebetween to inhibit fluid from leaking therebetween. The lobe 37 is located in a corresponding recess 39 in cylindrical section 34. This arrangement allows a ball and socket type movement between the plate 11 and the supporting member 24 and relative longitudinal movement therebetween.

Referring back to FIG. 2, a tool 4 for gripping a tubular is fixed and depends from the supporting member 24 of the apparatus 1. Such a tool may be arranged to be inserted into the upper end of the tubular, with gripping elements of the tool being radially displaceable for engagement with the inner wall of the tubular so as to secure the tubular to the tool.

In use, a tubular 40 to be connected to a tubular string held in a spider (not shown), is located over the tool 4. The tool 4 grips the tubular 40. The apparatus 1 and the tubular 40 are lowered by moving the top drive so that the tubular 40 is in close proximity with the tubular string held in the spider. However, due to, amongst other things, manufacturing tolerances in the tubular 40, the tubular often does not align perfectly with the tubular held in the spider. The apparatus 1 allows minor vertical and horizontal movements to be made. The piston and cylinders 28 and 29 allow vertical movement, and may be controlled remotely. The piston and cylinders 28 and 29 may be of the pneumatic compensating type, i.e. their internal pressure may be adjusted to compensate for the weight of the tubular 40 so that movement of the tubular may be conducted with minimal force. Pneumatic compensating piston and cylinders also reduce the risk of damage to the threads of the tubulars. This can conveniently be achieved by introducing pneumatic fluid into the piston and cylinders 28 and 29 and adjusting the pressure therein. The piston and cylinders 28 and 29 may be hydraulic or may be hydraulic and provided with pneumatic bellows.

Tubular manipulating equipment such as stabbing guides may be used to direct the pin (not shown) of the tubular 40 into the box of the tubular string held in the spider. The apparatus 1 allows horizontal movement of the tubular 40 relative to the top drive 3. Once the tubular 40 is in line with the tubular string, the top of the tubular 40 may be brought in line with the top drive which may be carried out with pipe handling equipment. The top drive 3 is now in direct alignment with the tubular string held in the spider, and can now rotate the apparatus 1 and hence the tool 4 and the tubular 40 to perfect a connection between the tubular 39 and the tubular string.

Figure 4:
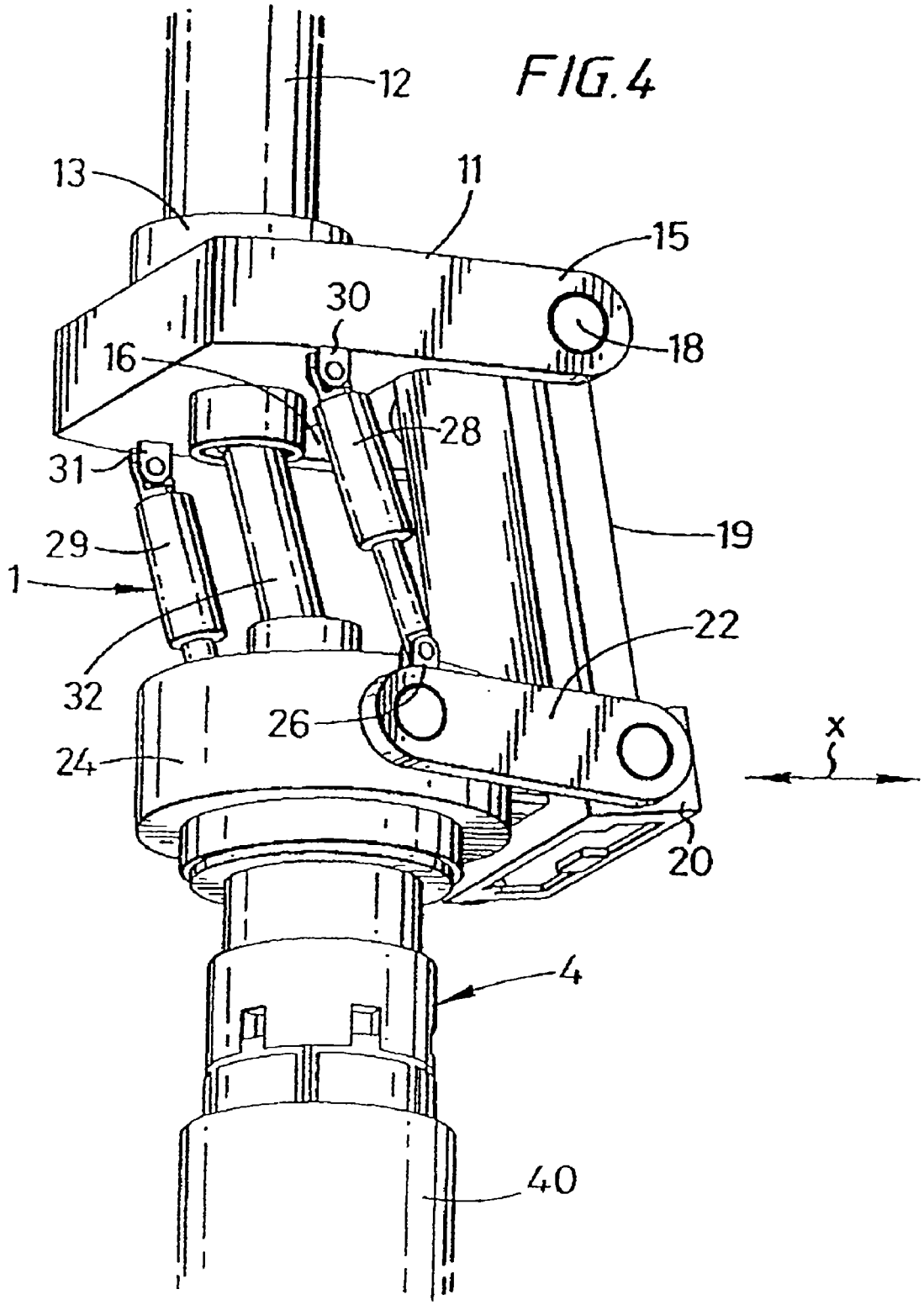
FIG. 4 is an enlarged view of parts of the supports of FIG. 1 in a displaced position.

FIG. 4 shows the supporting member 24, the tool 4 and the tubular 40 laterally in a 'Y' direction out of alignment with the top drive 3. The mud pipe 32 has moved in recesses 36 and 39 and longitudinally in relation to o-ring seals 38. The piston and cylinders 28 and 29 have moved about lugs 26, 27, 30 and 31. Arms 22 and 22' have moved about spherical bearings 23, 23', 25 and 25'.

Figure 5:
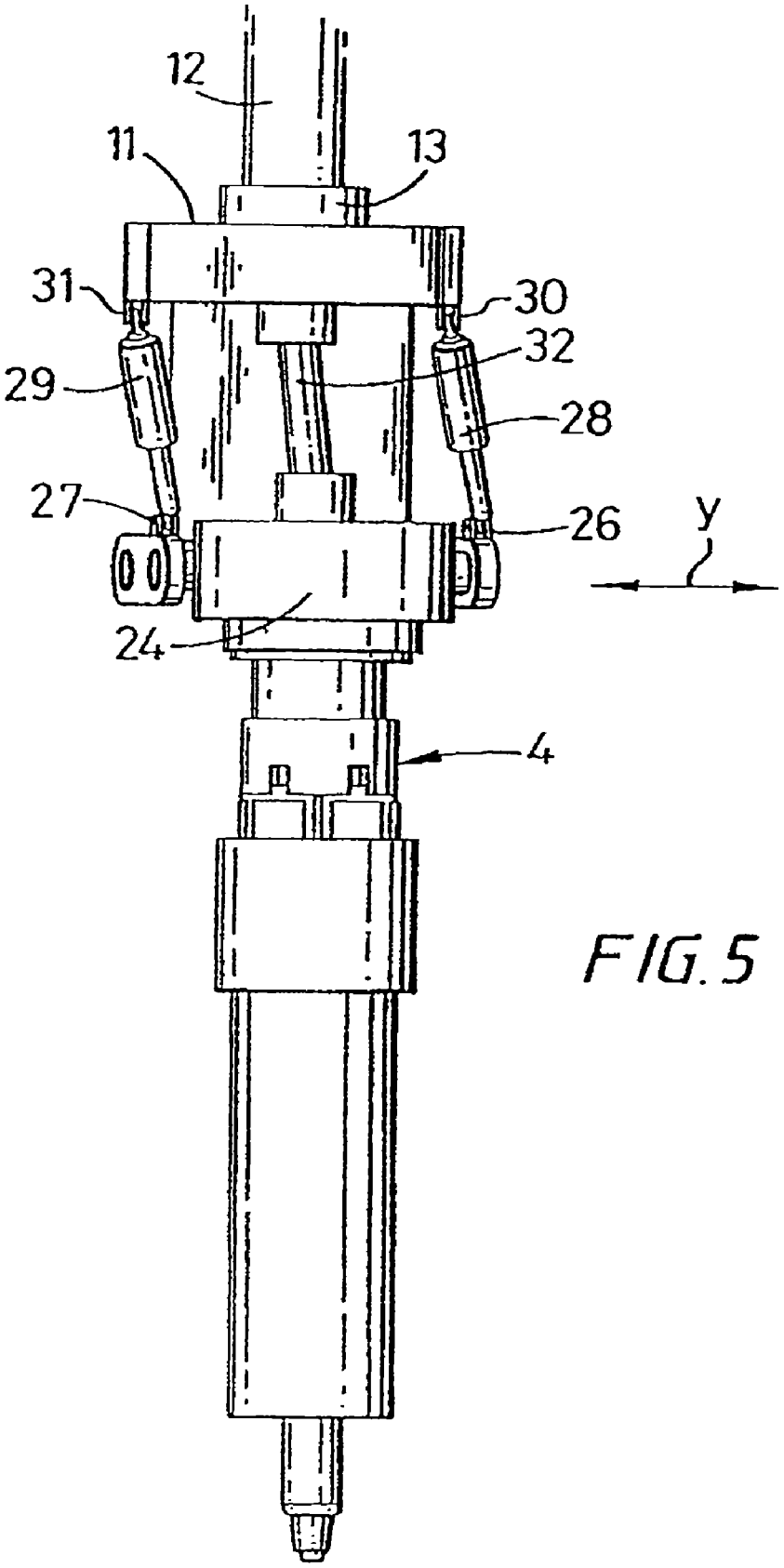
FIG. 5 is an enlarged view of parts of the apparatus of FIG. 1 in a second displaced position.

FIG. 5 shows the supporting member 24, the tool 4 and the tubular member 40 laterally in an 'x' direction. The mud pipe 32 has moved in recesses 36 and 39 and longitudinally in relation to o-ring seals 38. The piston and cylinders 28 and 29 have moved about lugs 26, 27, 30 and 31. Rigid member 19 has moved about axles 18 and 18' and spherical bearings 23.

Figure 6:
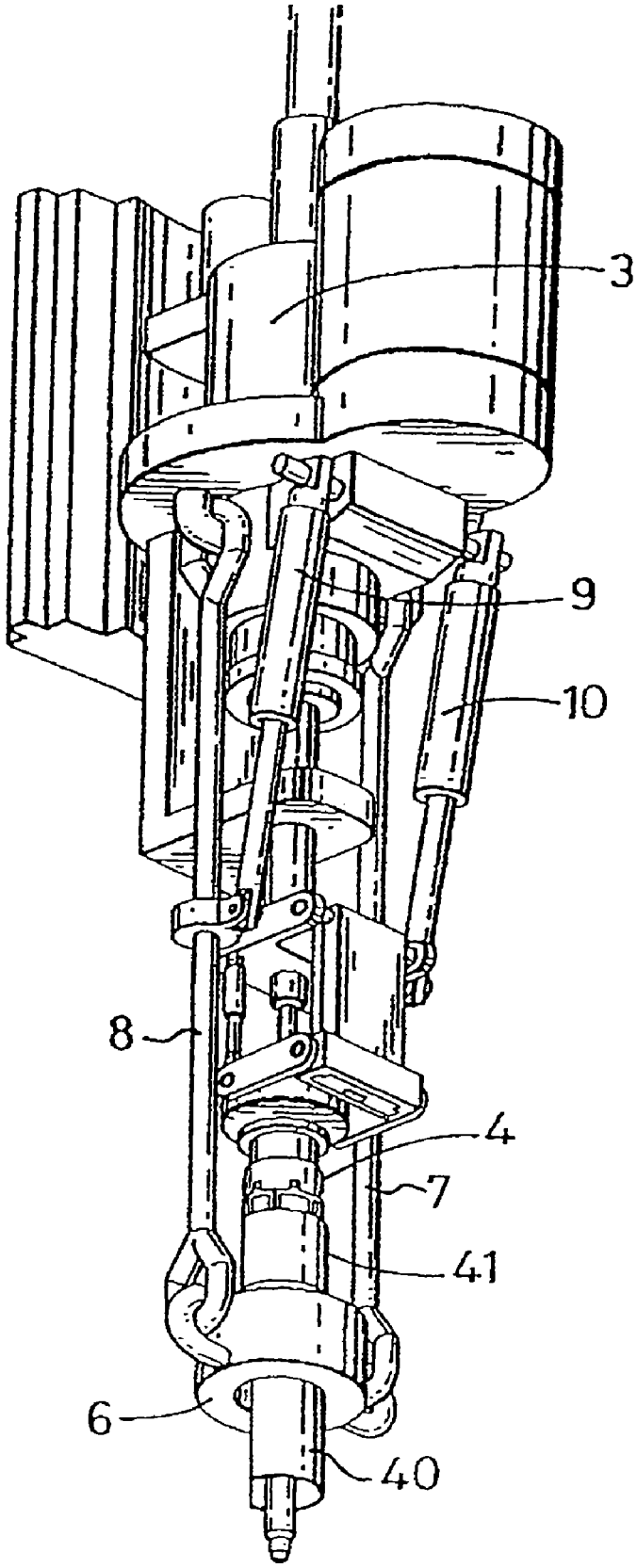
FIG. 6 shows the apparatus of FIG. 1 in a further stage of operation.

FIG. 6 shows the elevator 6 swung in line with the top drive 3 by rotation of the piston and cylinders 9 and 10 acting on bails 7 and 8. The elevator 3 is located below a box 41 of tubular 40. The tubular 40 may be released from engagement with the tool 4. The elevator 6 may now be raised to take the weight of the tubular 40 and tubular string. The tubular string may now be lowered into the well.

Figure 7:
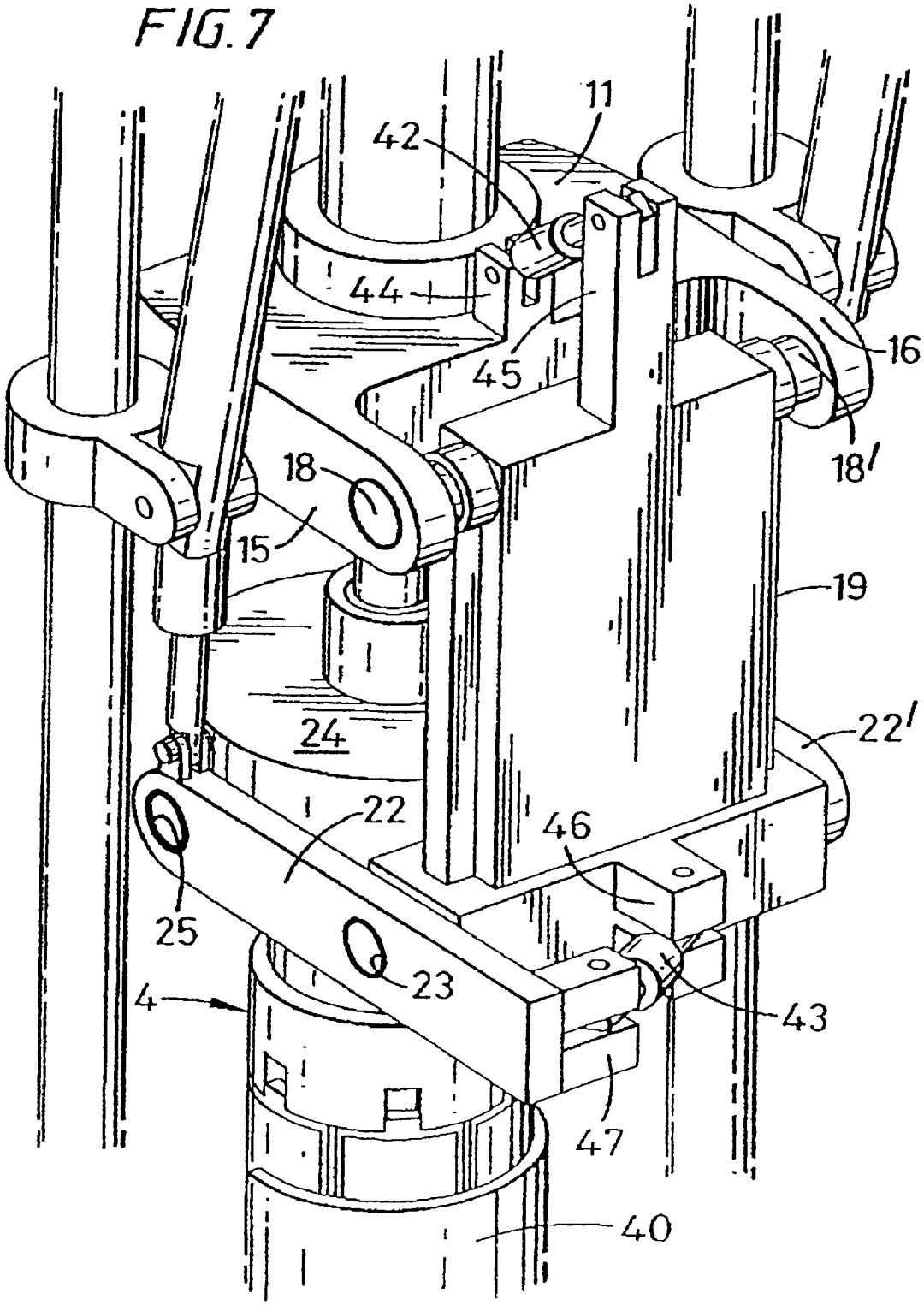
FIG. 7 shows a second embodiment of the present invention.

FIG. 7 is a second embodiment of the present invention and is generally similar to that of FIGS. 1 to 6 further incorporating adjusting piston and cylinders 42 and 43 so that actuation of the piston and cylinders 42 and 43 can move the supporting member 24, the tool 4 and the tubular 40 depending therebelow in a horizontal plane in an x and y axis.

The piston and cylinder 42 is arranged between the plate 11 and the rigid member 19 on lugs 44 and 45. Actuation of the piston and cylinder 42 moves the supporting member 24, the tool 4 and the tubular 40 along a generally x-axis about axles 18 and 18'.

The piston and cylinder 43 is arranged between an extension of arm 22 and slider 20 on lugs 46 and 47. Actuation of the piston and cylinder 43 moves the supporting member 24, the tool 4 and the tubular 40 along a generally y-axis about spherical bearings 23, and 25 and the corresponding spherical bearings arranged in arm 22'.

The piston and cylinders 42 and 43 may be hydraulically of pneumatically operable and may be controlled via a remote control unit (not shown).

In use, a tubular 40 may be gripped by the tool 4 in the way described above and lowered into close proximity with the tubular string held in a spider. The adjusting piston and cylinders 42 and 43 may then be actuated to obtain alignment of the pin of the tubular 40 with the box of the tubular string held in the spider. The tubular 40 may then be rotated to obtain a partial connection or be held in alignment with an additional tool. The piston and cylinders 42 and 43 may then be returned to their original positions to obtain alignment with the top drive 3. The top drive 3 may then be used to torque the connection up to a predetermined torque to complete the connection.

It is envisaged that various modifications may be made to the above described embodiments, such as using a hydraulic motor in place of the supporting member 24.

While the foregoing is directed to embodiments of the present invention, other and further embodiments of the invention may be devised without departing from the basic scope thereof, and the scope thereof is determined by the claims that follow.

The invention claimed is:

1. A method of connecting a first tubular to a second tubular using a top drive, comprising:

coupling a tubular gripping member to the top drive, wherein the tubular gripping member is movable horizontally relative to the top drive and the tubular gripping member having radially movable gripping elements;

engaging the first tubular using the tubular gripping member;

moving the first tubular relative to the top drive to align the first tubular with the second tubular; and rotating the first tubular relative to the second tubular using the top drive, thereby connecting the first tubular and second tubular.

2. The method of claim 1, further comprising aligning the first tubular with the top drive before completing connection of the first tubular and the second tubular.

3. The method of claim 1, wherein the tubular gripping member is coupled to the top drive using a connection apparatus having a body having a first joint coupled to the top drive and a second joint coupled to the tubular gripping member, wherein the body is adapted to allow fluid communication between the top drive and the tubular gripping member and to allow relative movement between the top drive and the tubular gripping member.

4. The method of claim 3, further comprising slidably coupling the body to at least one of the top drive and the tubular gripping member.

5. The method of claim 3, wherein the body is pivotable relative to at least one of the top drive and the tubular gripping member.

6. The method of claim 3, wherein the first joint comprises an arcuate member.

7. The method of claim 6, wherein the arcuate member is coupled to a connection member.

8. The method of claim 7, wherein the connection member includes a recess for receiving the arcuate member.

9. The method of claim 1, further comprising moving the tubular gripping member vertically relative to the top drive.

10. The method of claim 1, further comprising providing a compensating apparatus to move the tubular gripping member relative to the top drive.

11. The method of claim 10, wherein the compensating apparatus is pneumatically operated.

12. The method of claim 11, wherein the compensating apparatus comprises a cylinder.

13. The method of claim 1, further comprising compensating for a weight of the first tubular during connection of the first tubular and the second tubular.

14. The method of claim 13, further comprising providing a compensating cylinder to compensate for the weight.

15. The method of claim 14, wherein the compensating cylinder is pneumatically operated.

16. The method of claim 14, wherein the compensating cylinder is hydraulically operated.

* * * * *

UNITED STATES PATENT AND TRADEMARK OFFICE

CERTIFICATE OF CORRECTION

PATENT NO. : 8,132,626 B2
APPLICATION NO. : 12/615047
DATED : March 13, 2012
INVENTOR(S) : Pietras It is certified that error appears in the above-identified patent and that said Letters Patent is hereby corrected as shown below:

Title Page, Related U.S. Application Data (63):

Please delete "filed as application No. PCT/GB99/02710 on Aug. 16, 1999, now Pat. No. 6,976,298." and insert --filed on May 10, 2001, now Pat. No. 6,976,298, which is a 371 of PCT/GB99/02710, filed on Aug. 16, 1999.-- therefor.

Signed and Sealed this
Twenty-seventh Day of November, 2012

David J. Kappos

David J. Kappos
*Director of the United States Patent and Trademark Office*